US006053494A

United States Patent [19]

Baskette et al.

[11] Patent Number: 6,053,494

[45] Date of Patent: Apr. 25, 2000

[54] JOB OFFSET ASSEMBLY

[75] Inventors: Michael Wesley Baskette; Michael Earl Kennedy, both of Lexington, Ky.

[73] Assignee: Lexmark International, Inc., Lexington, Ky.

[21] Appl. No.: 08/905,658

[22] Filed: Aug. 4, 1997

[51] Int. Cl.[7] ..... B65H 9/16

[52] U.S. Cl. ..... 271/251; 271/274

[58] Field of Search ..... 271/250, 251, 271/274; 198/349.4

[56] References Cited

U.S. PATENT DOCUMENTS

| | | | |
|---|---|---|---|
| 3,624,807 | 11/1971 | Schwebel | 271/74 |
| 3,915,449 | 10/1975 | Johnson et al. | 271/251 |
| 3,945,636 | 3/1976 | Kockler et al. | 271/274 |
| 4,017,066 | 4/1977 | Lasher et al. | 271/80 |
| 4,162,786 | 7/1979 | Bullock | 271/64 |
| 4,477,218 | 10/1984 | Bean | 414/36 |
| 4,486,014 | 12/1984 | Enoguchi et al. | 271/200 |
| 4,836,527 | 6/1989 | Wong | 271/251 |
| 4,890,825 | 1/1990 | McCormick et qal. | 271/188 |
| 4,977,432 | 12/1990 | Coombs et al. | 355/309 |
| 4,982,941 | 1/1991 | Phillips et al. | 271/84 |
| 4,989,853 | 2/1991 | Matysek et al. | 270/58 |
| 5,167,409 | 12/1992 | Higeta . | |
| 5,172,904 | 12/1992 | Sze et al. | 271/187 |
| 5,188,353 | 2/1993 | Parks | 271/184 |
| 5,358,238 | 10/1994 | Mandel et al. | 271/298 |
| 5,390,910 | 2/1995 | Mandel et al. | 271/296 |
| 5,434,661 | 7/1995 | Takahashi et al. | 348/8 |
| 5,662,321 | 9/1997 | Borostyan et al. . | |

FOREIGN PATENT DOCUMENTS

WO 95/33602 12/1995 WIPO .

OTHER PUBLICATIONS

Abstract–600002543, Kai Hidetaka, Jan. 8,1985.
Abstract–60002544, Kai Hidetaka, Jan. 8, 1985.

*Primary Examiner*—Christopher P. Ellis
*Assistant Examiner*—Mark A. Deuble
*Attorney, Agent, or Firm*—John A. Brady

[57] ABSTRACT

A job offset assembly to separate into multiple stacks the output from a copier, printer or the like, includes a platform upon which a plurality of offset assemblies are rotatably mounted, each offset assembly including a skew roller which turns about an axis that, when the offset assemblies are rotated, is not parallel to the axis about which a drive roller associated with the skew roller turns. A gear or rack-and-pinion type offset actuation system enables the offset assemblies to rotate repeatedly back and forth between predetermined positions, so that as media encounters the skew rollers it is directed against a reference edge and into an output stack associated with the offset assembly position.

6 Claims, 5 Drawing Sheets

JOB OFFSET ASSEMBLY

FIELD OF THE INVENTION

The present invention relates generally to an offset or "jogging" system to separate print jobs in printers, copiers, separate attached options for these devices, and the like. More specifically, the present invention is directed to a job offsetting system including a plurality of pivoting roller assemblies for translating against one or more reference edges media that is driven through the paper path of the printer, copier, or output option.

BACKGROUND OF THE INVENTION

The basic function of job offset or "jogging" to separate print jobs in printers, copiers, and separate attached output options for such devices generally has been known for some time. However, many of the prior approaches to achieving this function are expensive in that they are integrated into large, multi-function devices, and they comprise complex mechanisms. For example, many such prior devices require movable output trays, paper stack elevators, and/or shifting paper paths to offset print jobs. Other approaches utilize techniques to adjust pages "in-flight" as they fall into an output bin, or to adjust an output stack as the pages are deposited onto it.

There are a number of drawbacks associated with prior job offsetting systems such as those mentioned above. For example, most prior offset systems are limited in that the pages being output can be deposited into only two positions in the area in which the offsetting is executed. In "tray offset" schemes, the receptacle tray is physically translated or moved in a direction perpendicular to the paper travel direction. Since the tray is exposed to customers who must have access to the bin, such motion presents a distraction, and may even be a hazard. Also, for large capacity bins, large forces can be required to achieve the necessary movement. In job offset systems utilizing translating shaft-roller pairs, typically the final shaft-roller pair nearest the paper exit in the paper path is translated along the plane of the media being processed in a direction perpendicular to the media travel direction. Implementing such a scheme is quite complex, for the offset control system must adapt to or control a number of factors. For example, to avoid damage to the media, the media to be translated must clear all other drive roller pairs before the exit shaft pair, with the media still between the exit drive rollers, is translated; the translation must be complete before the trailing edge of the media leaves the exit roller pair; the exit shaft pair must reset to its original position before the leading edge of the next page reaches the exit rollers; and a separate translation-reset motion must be completed for every page that is to be offset. Further, in translating carriage systems both the back-up rollers and the drive rollers must be translated, requiring that special consideration be given to the design of the drive shaft and rollers, particularly in connecting rotational drive motion to the drive rollers. Finally, "tamping" offset systems require some type of flipper or other such device to "flick" the media to one side of a receptacle tray. Control of the media and achieving consistent placement can be problematic with such systems, since the jogging occurs when the media is "in flight" and has cleared all of the back-up and drive rollers. Thus, there are a number of significant drawbacks associated with prior job offset systems.

SUMMARY OF THE INVENTION

In accordance with the present invention, a job offset system is provided which overcomes the above-noted and other shortcomings of prior systems for achieving a job offset function, and which enables the addition of a job offset capability to the paper path of a printer, copier, or output option. Although the present invention is suitable for use in a wide variety of applications involving printers, copiers, or output options for such devices, for convenience reference will be made herein only to an exemplary application involving a printer.

Thus, in accordance with the present invention, a job offset mechanism or assembly is mounted on a platform that serves as a first half of an end portion of a printer paper path. The platform comprises the mounting location for one or more assemblies comprising a pivoting roller housing, a shaft, a skew roller and a spring. The parts in each assembly are secured to the platform by a retainer which permits rotation, but which constrains vertical and horizontal movement. The platform including one or more mounted offset mechanisms mates against a second half portion of the paper path and against drive rollers to form a roller system capable of transporting media. The skew rollers "back-up" to the drive rollers, with the spring loading the roller pair together.

In a "normal" operation mode, in which no job offset is desired, the media is driven in a straight path out of the printer and into an output paper tray. The skew rollers in the pivoting housings remain aligned along the same rolling axis as the drive rollers. Thus, the skew rollers in normal operation mode behave much like typical "back-up" rollers found in many prior paper drive systems. When offset is desired, however, each mounted roller housing rotates about its center in the plane of the media path while the drive rollers remain straight. Accordingly, to achieve offset, roller pairs are created that have skewed rolling axes.

As media passes through the skewed roller pairs, the media is translated against a side reference edge that is positioned at a desired offset distance. The rate at which the media moves toward the reference edge varies, depending upon the circumstances involved in the particular desired application, based upon the skew angle of the skew roller with respect to the drive roller; the coefficient of friction between the roller pair materials and the media; and the load between the rollers. The job offset assembly preferably allows the offset of print jobs both to the right and to the left of the normal paper path, so that there are three possible offset paper stacks in the output tray.

Accordingly, the side reference edge or guide at least partially defines a media pathway different from the straight path referred to herein that is used when in a normal operation mode. One or more side reference edges are capable of defining a plurality of media pathways, each of which may correspond to a distinct output stack. Typically, the media pathways will be parallel to each other and to the first, normal operation mode pathway, and at least one drive roller is capable of moving media along the separate paths. Of course the exact configuration, direction, and location of the pathways and associated drive mechanisms will depend upon the particular circumstances involved in a desired application.

Accordingly, as described herein, and in accordance with the present invention, a means is provided for one or more of the following: for changing the direction of travel of media proceeding along a pathway, for directing media on a first pathway against or toward a side reference edge or guide that at least partially defines a pathway different from the first; and for otherwise moving media between a plurality of pathways. Further, the present invention allows media traveling along a first pathway to be placed into an output stack or position that is removed from the first pathway and that corresponds to a pathway different from the first. The present invention includes means for directing media traveling or moving along a pathway into one of a plurality of spaced media output positions.

Actuation of the job offset mechanism described herein can be accomplished by a variety of means. In a first embodiment, an offset actuation gear is mounted to the platform between the pivoting housings. Mating gear teeth on each of the housings engage the actuation gear so that the housings rotate in the same direction as the actuation gear is rotated. The actuation gear is rotated by a pinion coupled to a motor, e.g., a stepper motor. Motor rotation is controlled by conventional means to position the skew roller angle to the predetermined left, straight, or right positions. If the spacing between the roller housings is large, a gear train of an odd number of gears can be used in place of a single actuation gear.

In alternate embodiments, a linear single bar mechanism is used to actuate the skew system. In such embodiments, a bar or rack is operatively coupled to each pivoting housing, preferably by means of a pin-in-slot connection. In one embodiment, a motor coupled to a pinion drives the link bar through a rack-and-pinion type interface. As the link bar is moved back and forth, the skew rollers are positioned in any of the three predetermined target positions. In an alternate embodiment, the link arm is driven by a solenoid preferably directly connected to the link arm. However, in such an embodiment the skewing mechanism typically is limited to only two positions since solenoids generally are unable to provide positioning control to any location other than either end of the solenoid's travel range.

One of ordinary skill in the art having the benefit of this disclosure will of course recognize that the present invention is not necessarily limited to the specific embodiments generally described herein. For example, while the accompanying drawings show the skew rollers and platform on the upper half of the paper path, a system in which the positions of the components is reversed, i.e., so that the skew rollers and platform are located below drive rollers disposed above the paper path, is equally within the scope of the present invention. Likewise, while the paper path shown in the figures is horizontal, the present invention also contains within its scope assemblies including vertically or angularly oriented paths.

DETAILED DESCRIPTION OF THE INVENTION

Figure 1:
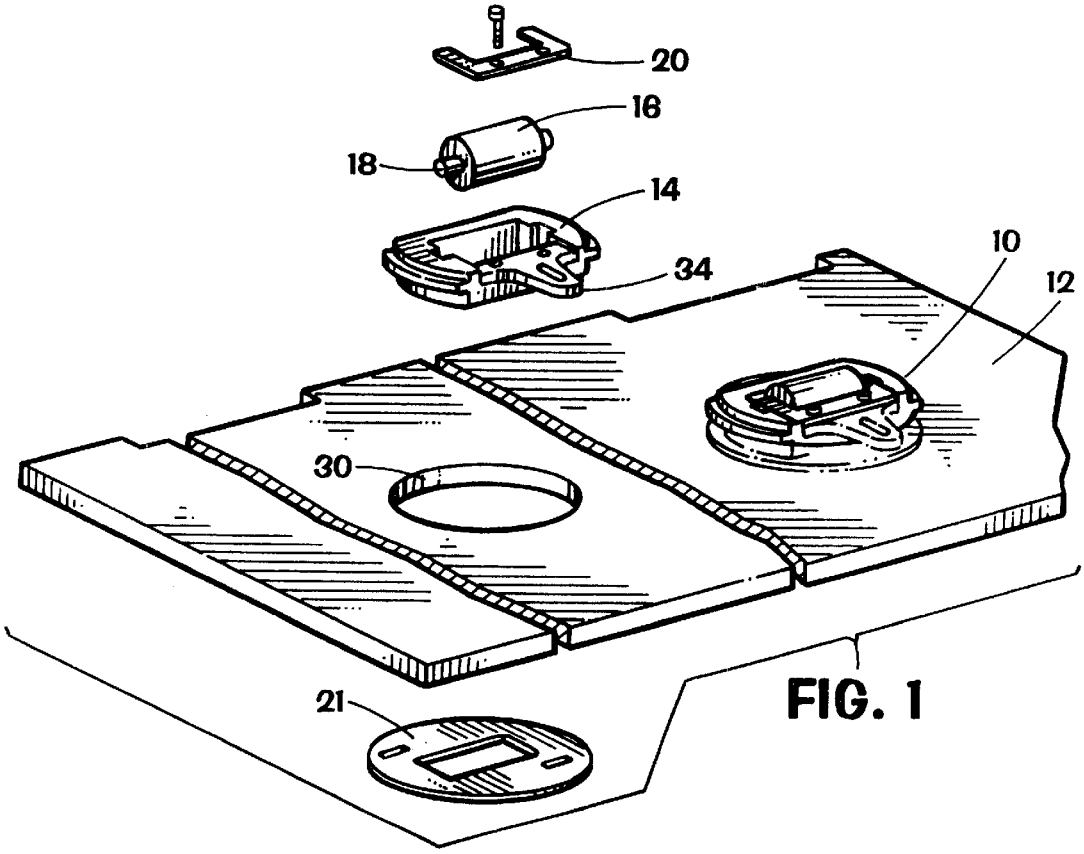
FIG. 1 is an illustration, in partially exploded view, of a job offset system in accordance with the present invention.
Figure 1A:
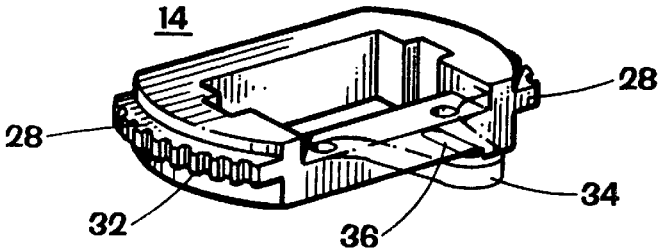
FIG. 1A is an illustration of an exemplary pivoting roller housing in accordance with the present invention.
Figure 2:
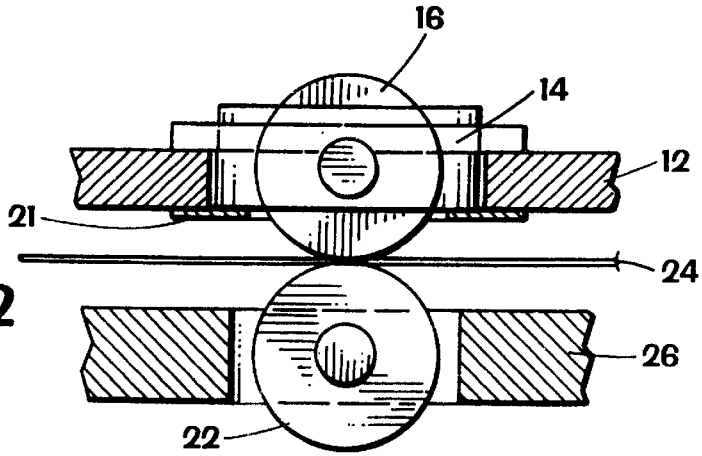
FIG. 2 is a cross-sectional illustration of an exemplary operating configuration for a job offset system in accordance with the present invention.

In accordance with the present invention, as shown in FIG. 1, a job offset system comprises a plurality of offset assemblies 10 rotatably mounted on a platform 12. The offset assembly 10 includes a pivoting roller housing 14, a skew roller 16, a skew roller shaft 18 and a back-up spring 20 secured in place by a retainer 21. The skew roller 16 and shaft 18 form a combination which preferably is disposed within the pivoting roller housing 14. The back-up spring 20 is seated within the roller housing 14 above the roller/shaft combination, and may be held in place by screws or by another similar fastening device, or by virtue of its placement within slots formed in the roller housing 14, or by other suitable means. The spring 20 preferably acts upon the roller shaft 18, forcing the roller/shaft combination downward, so that the skew roller of offset assembly 10 backs up to a drive roller 22 (see FIG. 2) to enable the transportation of media 24 along the paper path formed between the platform 12 and the drive roller platform or support 26. Of course the exact type, size and shape of the spring 20 or other form of compliant means engaging the roller shaft and housing will vary depending upon the circumstances involved in a particular desired application. The pivoting roller housing 14, shown in greater detail in FIG. 1A, preferably includes flanged portions 28, the bottoms of which preferably ride on or slightly above the top of platform 12, so as to allow the roller housing 14 to pivot within a hole 30 in platform 12. The flanged portions 28 may be adapted with grooves or teeth 32 to allow the pivoting roller housing 14 to interact with the gear to actuate rotation of the assembly 10. See, e.g., FIG. 6. The roller housing 14 also may be adapted to include an extension arm 34 (see FIG. 1A) including a slot 36 in which a pin that is part of a bar actuation system may move (see, e.g., FIGS. 7 and 8) so as to effect rotation of the assembly 10. The extension arm 34 may be either part of the housing 14 itself, i.e., a single piece construction, or may be secured to the housing 14 by screws or other suitable fastening means (e.g., by press fit, adhesives, or the like), i.e., a two piece construction.

Figure 3B:
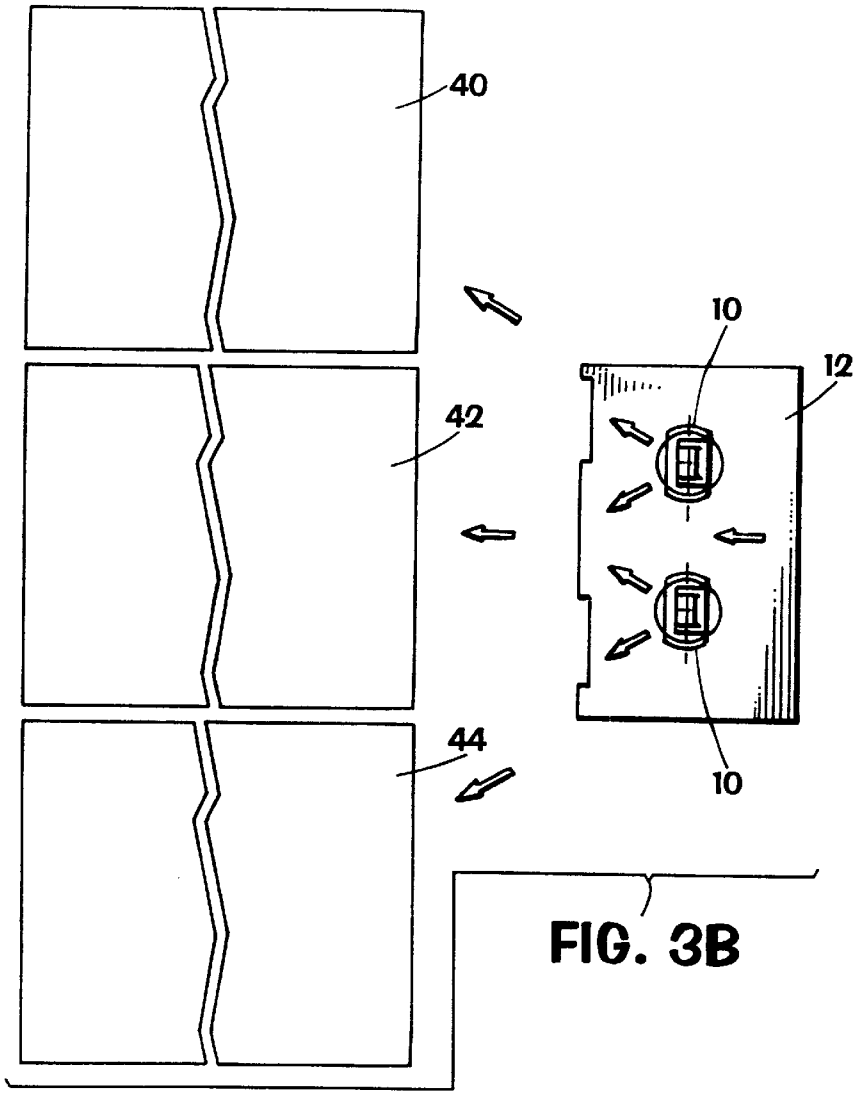
FIG. 3B is an illustration of an exemplary operating configuration for a job offset system in accordance with the present invention, depicted in view from above, showing, inter alia, exemplary left, right and straight paper paths and a plurality of job output locations.
Figure 3A:
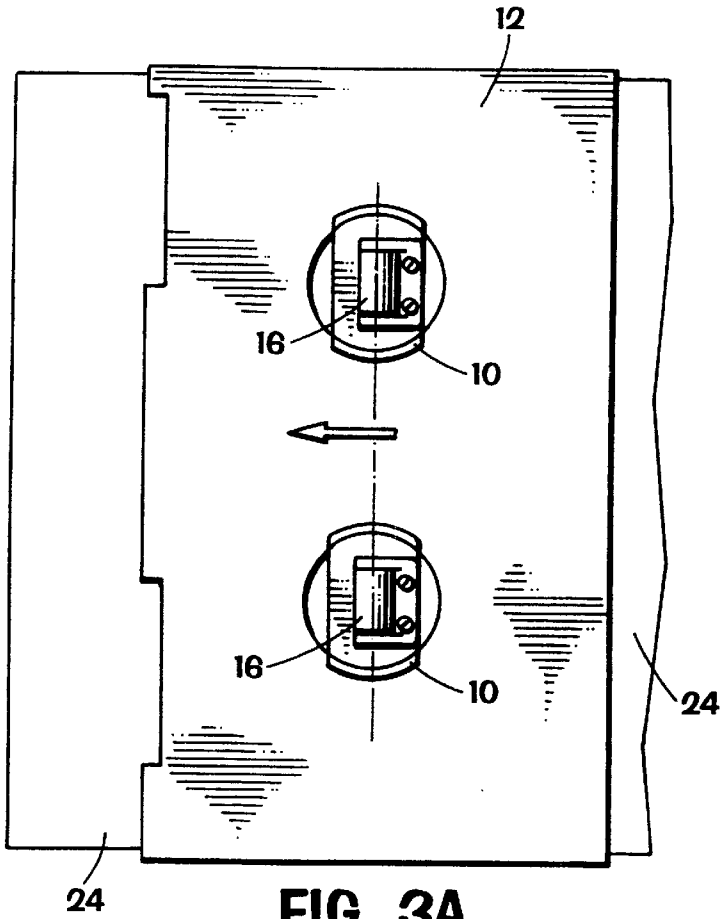
FIG. 3A is an illustration of an exemplary operating configuration for a job offset system in accordance with the present invention, depicted in view from above, showing, inter alia, a straight no offset paper path.

As illustrated in FIG. 3A, in "normal" operation the rolling axis of each of the skew rollers 16 of the offset assemblies 10 is aligned with the rolling axis of the drive roller 22 (see FIG. 2) that corresponds to each skew roller 16. In this configuration, the skew roller/drive roller pair functions much like a typical back-up paper drive: the media 24 travels in a straight, i.e., no offset, process path, and there is only one output stack for the media. However, in accordance with the present invention, as shown in FIG. 3B, in "offset mode" a plurality of separate output stacks 40, 42, 44 can be achieved by the rotation of the offset assemblies 10 either to the right or left.

Although FIG. 3B illustrates three possible separate offset stacks, the present invention is not so limited. Depending upon the circumstances involved in a particular application, it may be desirable to have one, two, three or more output stacks. Further, the stacks need not be separate; in some cases, having output stacks which overlap will be preferred.

Figure 5:
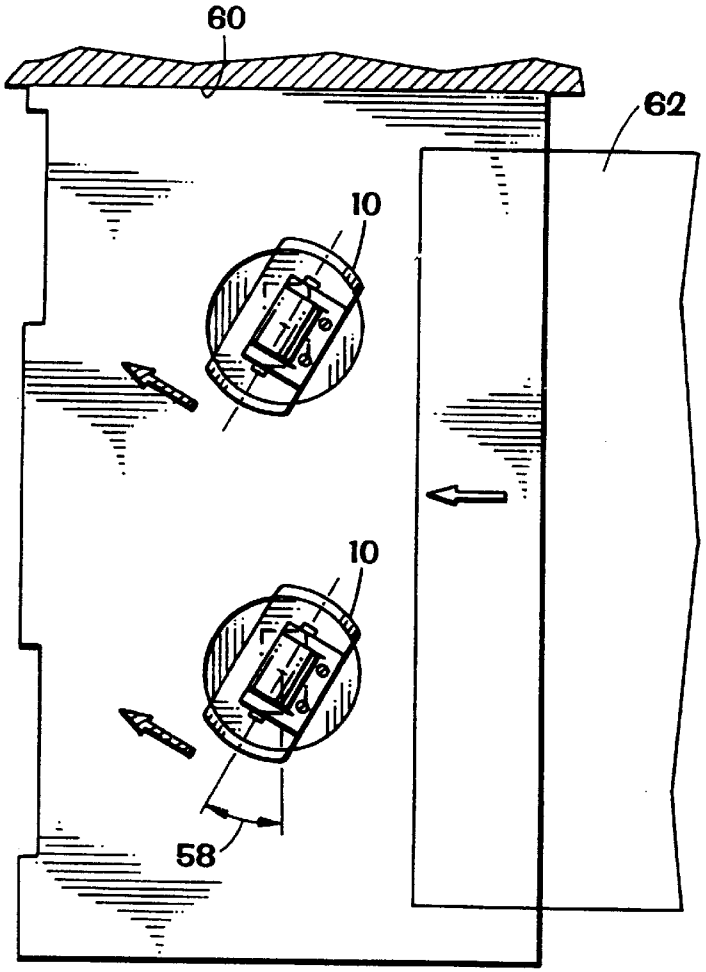
FIG. 5 is an illustration of an exemplary operating configuration for a job offset system in accordance with the present invention, depicted in view from above, showing, inter alia, an exemplary offset right paper path.
Figure 4:
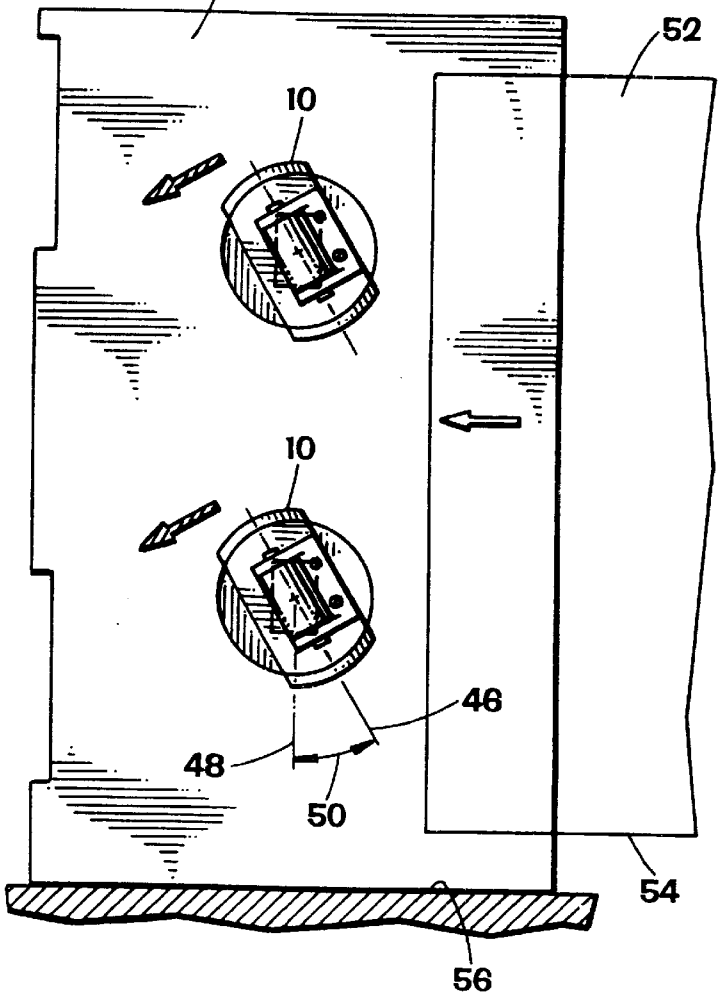
FIG. 4 is an illustration of an exemplary operating configuration for a job offset system in accordance with the present invention, depicted in view from above, showing, inter alia, an exemplary offset left paper path.

FIG. 4 shows an embodiment of the present invention in an exemplary "offset left" configuration. Viewed from above, the offset assemblies 10 are turned or rotated counter-clockwise, so that in each assembly 10 the rolling axis 46 of the skew roller and the rolling axis 48 of its corresponding drive roller form a skew angle 50. Media 52 traveling along a straight process path encounters the skew roller/drive roller pair, and the media 52 shifts left as it also is propelled forward, until the left edge 54 of media 52 runs against a reference edge 56. Preferably, the left edge 54 of media 52 will contact the reference edge 56 about the time that the traveling end of media 52 reaches the skew roller/drive roller pair. Similarly, FIG. 5 shows an embodiment of the present invention in an exemplary "offset right" configuration. In this case, the offset assemblies 10 are rotated clockwise (again as viewed from above), so as to form a skew angle 58 between the rolling axis of each skew roller and the rolling axis of the drive roller corresponding to the skew roller.

In some cases, it may be desirable to have a side reference edge 60 which translates in a direction perpendicular to the straight process path direction of the media 62. Under such circumstances, multiple output stacks can be achieved, for example, by coordinating an increase or decrease in the skew angle 58 with a desired outward or inward movement of the reference edge 60.

Figure 6:
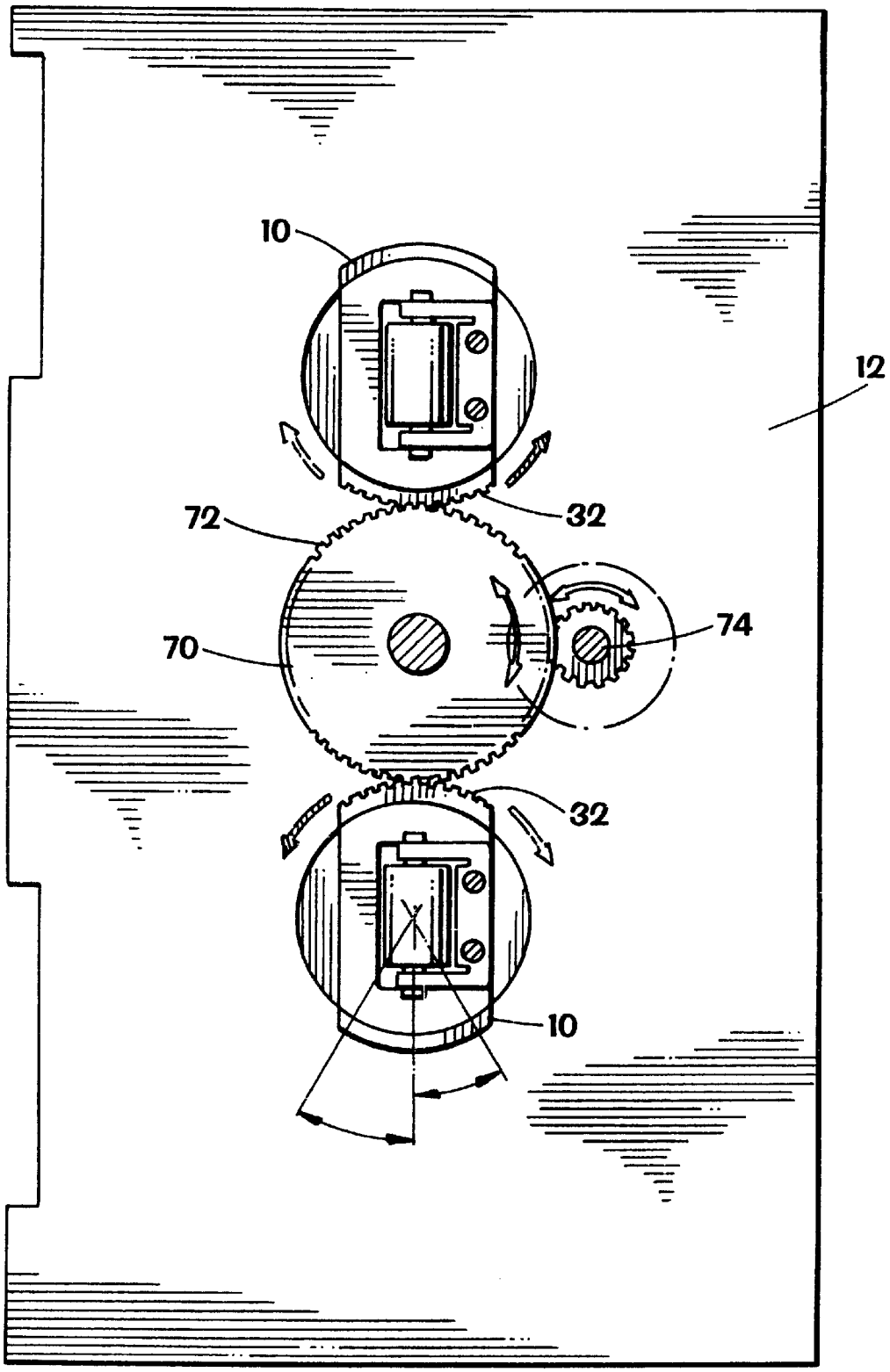
FIG. 6 is an illustration of an exemplary embodiment of a job offset system in accordance with the present invention including gear actuation.

FIG. 6 shows an exemplary offset actuation system in accordance with the present invention. An actuation gear 70 is coupled to the platform 12 between a pair of offset assemblies 10. The teeth 72 of actuation gear 70 mate with the teeth 32 of each pivoting housing, and with a pinion 74 coupled by a shaft to a motor (not shown). Preferably, the motor is a stepper motor capable of rotating the pinion in both clockwise and counter-clockwise directions, so that its action results in the pivoting of the offset assemblies 10 in both the clockwise (offset right) and counter-clockwise (offset left) directions. The motor preferably provides directional control so as to permit specific skew angles to be set in accordance with the circumstances involved in a particular desired application.

Figure 8:
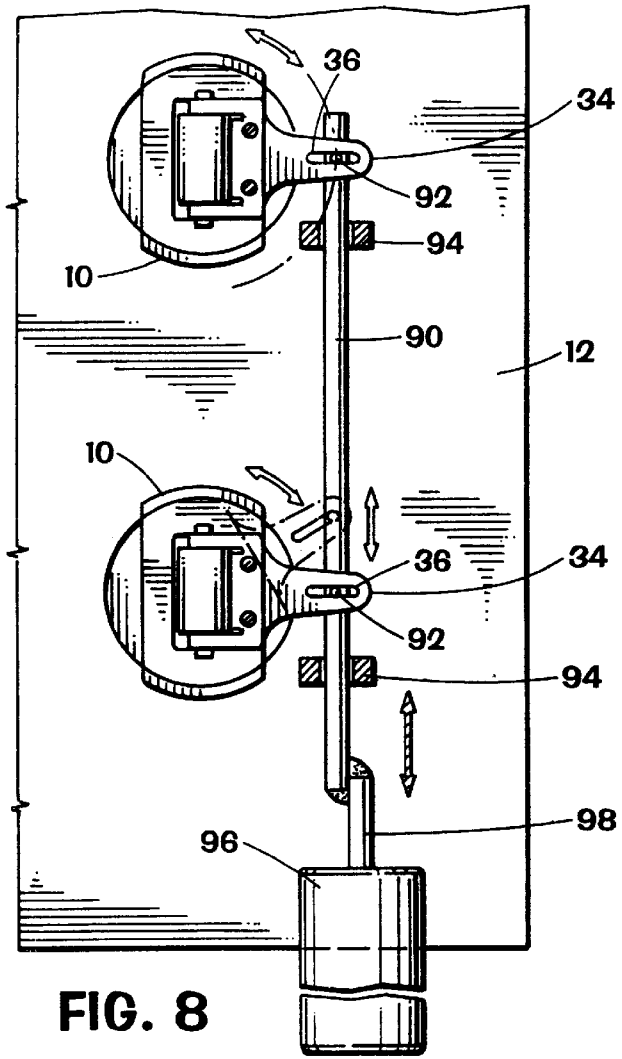
FIG. 8 is an illustration of an exemplary embodiment of a job offset system in accordance with the present invention including linear single bar actuation with a solenoid-type drive assembly.
Figure 7:
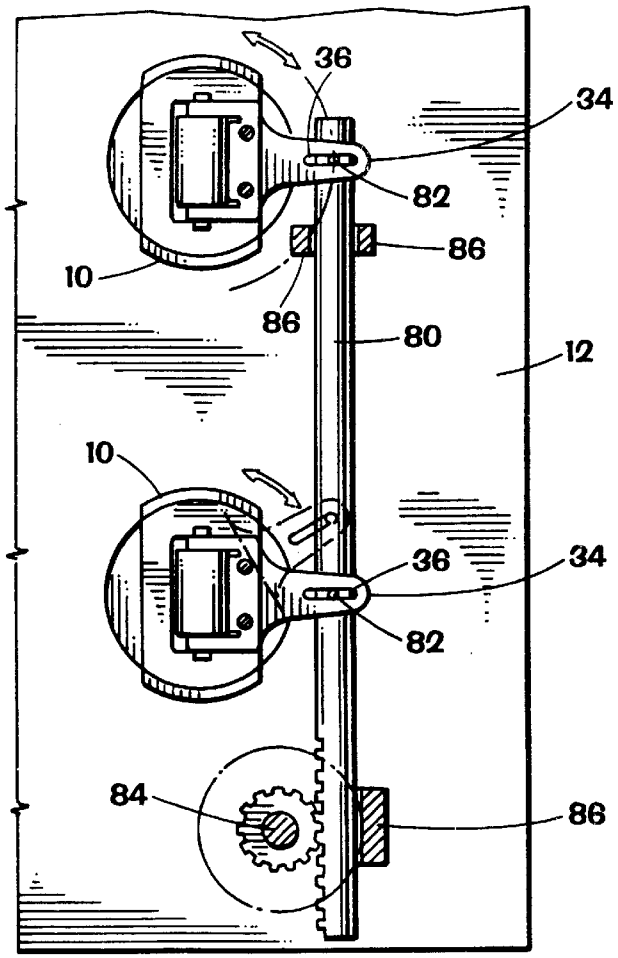
FIG. 7 is an illustration of an exemplary embodiment of a job offset system in accordance with the present invention including linear single bar actuation with a rack-and-pinion type drive assembly.

An alternative to the gear actuation system shown in FIG. 6 is a link bar actuation system, exemplary embodiments of which are shown in FIGS. 7 and 8. In FIG. 7, a link bar comprising a rack 80 includes for each assembly 10 a pin 82. The pin 82 is disposed within the slot 36 of the arm extension 34. A pinion 84 preferably operatively coupled to a stepper motor (not shown) mates with the rack to form a rack-and-pinion type offset actuation system. That is, as the motor turns the pinion 84, the rack 80, which is preferably mounted to platform 12 with bearing restraints 86, turns the offset assemblies 10 to one side or the other. In FIG. 8, a link bar 90 is similarly coupled to the offset assemblies 10 by pins 92 and mounted to platform 12 by bearing restraints 94. A solenoid 96 is operatively coupled via action arm 98 to the link bar 90, so that the back and forth action of the arm 98 of solenoid 96 causes the pivoting assemblies to rotate from one side to the other.

Although the preferred embodiment of this invention has been described herein in some detail, it should be appreciated that a variety of embodiments will be readily available to persons utilizing the invention for a specific end use. The description of the apparatus of this invention is not intended to be limiting on this invention, but is merely illustrative of the preferred embodiment of this invention. Other apparatus and methods which incorporate modifications or changes to that which has been described herein are equally included within this application. Additional objects, features and advantages of the present invention will become apparent by referring to the above description of the invention in connection with the accompanying drawings.

What is claimed is:

1. A job offset system, comprising:

a drive roller;

a platform partially defining a straight media pathway proximate said drive roller;

a skew roller assembly rotatably coupled to said platform, said skew roller assembly comprising a housing engaging said platform in pivoting relation along the plane of said platform within a hole in said platform, a skew roller mounted upon a shaft and at least partially disposed proximate said drive roller, and a spring operatively coupled between said shaft and said housing and acting so that said skew roller naturally tends to engage said drive roller; and means for rotating said skew roller assembly so that media traveling said pathway changes direction upon engaging said drive roller and said skew roller.

2. The job offset system of claim 1, wherein said means for rotating said skew roller assembly comprises a gear actuation system including an actuation gear operatively coupled to said housing and to a motor driven pinion.

3. The job offset system of claim 1, wherein said means for rotating said skew roller assembly comprises a bar actuation system operatively coupled to said housing.

4. The job offset system of claim 3, wherein said bar actuation system comprises a link bar driven by a solenoid.

5. The job offset system of claim 3, wherein said bar actuation system comprises a rack-and-pinion.

6. A job offset system, comprising:

a drive roller;

a platform partially defining a straight media pathway proximate said drive roller;

a skew roller assembly rotatably coupled to said platform, said skew roller assembly comprising a housing engaging said platform in pivoting relation along the plane of said platform, a skew roller mounted upon a shaft and at least partially disposed proximate said drive roller, and a spring operatively coupled between said shaft and said housing and acting so that said skew roller naturally tends to engage said drive roller; and a gear actuation system including an actuation gear operatively coupled to said housing and to a motor driven pinion for rotating said skew roller assembly so that media traveling said pathway changes direction upon engaging said drive roller and said skew roller.

* * * * *